US008480138B2

(12) United States Patent
Bendel et al.

(10) Patent No.: US 8,480,138 B2
(45) Date of Patent: Jul. 9, 2013

(54) LOCK DEVICE HAVING A MULTI-PART PAWL

(75) Inventors: Thorsten Bendel, Oberhausen (DE); Serkan Gülkan, Hattingen (DE); Dirk Hanisch, Köln (DE); Ulrich Weichsel, Duisburg (DE); Karsten Barth, Hattingen (DE); Klaus Töpfer, Sindelfingen (DE); Hans Deischl, Jettingen (DE); Stefan Ebersohn, Böblingen (DE); Martin Lindmayer, Sulz (DE); Wolfgang Much, Ammerbuch (DE)

(73) Assignee: Kiekert AG, Heiligenhaus (DE)

( * ) Notice: Subject to any disclaimer, the term of this patent is extended or adjusted under 35 U.S.C. 154(b) by 399 days.

(21) Appl. No.: 12/515,951

(22) PCT Filed: Nov. 2, 2007

(86) PCT No.: PCT/DE2007/001974

§ 371 (c)(1),
(2), (4) Date: Jul. 13, 2009

(87) PCT Pub. No.: WO2008/061491

PCT Pub. Date: May 29, 2008

(65) Prior Publication Data

US 2010/0052336 A1 Mar. 4, 2010

(30) Foreign Application Priority Data

Nov. 22, 2006 (DE) ..... 10 2006 055 438
Jan. 26, 2007 (DE) ..... 10 2007 003 948

(51) Int. Cl.
*E05C 3/06* (2006.01)

(52) U.S. Cl.
USPC ..... 292/201; 292/216

(58) Field of Classification Search
CPC ..... E05B 1/14; E05B 5/26; E05B 1/06
USPC ..... 292/201, 216, DIG. 23
See application file for complete search history.

(56) References Cited

U.S. PATENT DOCUMENTS 3,905,624 A * 9/1975 Fujita ..... 292/11
5,118,146 A * 6/1992 Watanuki ..... 292/216

(Continued)

FOREIGN PATENT DOCUMENTS

DE 101 14 065 A1 11/2002
DE 10114065 11/2002

(Continued)

*Primary Examiner* — Thomas Beach
*Assistant Examiner* — Nathan Cumar
(74) *Attorney, Agent, or Firm* — Renner, Otto, Boisselle & Sklar, LLP

(57) ABSTRACT

A lock unit (1) for a motor vehicle, comprising at least a catch (2), a first pawl (3) having a pawl rotation axis (4), and a blocking lever (5), in which the catch (2) in a locked state of the lock unit (1) transfers a pivoting moment onto the first pawl (3) and in which the first pawl (3) is fixed by a blocking lever (5) and in which a second pawl (6) is provided that is mounted on the pawl rotation axis (4) and is engageable with the blocking lever (5) and the catch (2).

20 Claims, 7 Drawing Sheets

U.S. PATENT DOCUMENTS

| | | | | |
|---|---|---|---|---|
| 5,938,252 | A * | 8/1999 | Uemura et al. | 292/201 |
| 6,106,033 | A * | 8/2000 | Ruckert | 292/216 |
| 6,519,986 | B2 * | 2/2003 | Wicker | 70/237 |
| 6,520,550 | B2 * | 2/2003 | Kunst et al. | 292/216 |
| 6,540,272 | B2 * | 4/2003 | Spurr | 292/216 |
| 6,568,720 | B1 * | 5/2003 | Szablewski | 292/201 |
| 6,705,649 | B1 * | 3/2004 | Reddmann | 292/216 |
| 6,883,839 | B2 * | 4/2005 | Belmond et al. | 292/201 |
| 6,932,393 | B2 * | 8/2005 | Erices | 292/216 |
| 7,810,853 | B2 * | 10/2010 | Margheritti | 292/216 |
| 2001/0048227 | A1 * | 12/2001 | Kachouh | 292/216 |
| 2003/0116977 | A1 * | 6/2003 | Erices | 292/201 |
| 2011/0012376 | A1 * | 1/2011 | Hunt et al. | 292/216 |
| 2011/0127780 | A1 * | 6/2011 | Barth et al. | 292/213 |

FOREIGN PATENT DOCUMENTS

| | | | |
|---|---|---|---|
| EP | 1 256 676 | A2 | 11/2002 |
| EP | 1 380 715 | A1 | 1/2004 |
| FR | 2 607 546 | A1 | 6/1988 |
| FR | 2607546 | | 6/1988 |
| GB | 2 334 297 | A | 8/1999 |
| WO | 00/04262 | A1 | 1/2000 |

* cited by examiner

LOCK DEVICE HAVING A MULTI-PART PAWL

CROSS-REFERENCE TO RELATED APPLICATIONS

This is a National Stage Application of International Patent Application No. PCT/DE2007/001974, with an international filing date of Nov. 2, 2007, which is based on German Patent Application No. 10 2006 055 438.8, filed Nov. 22, 2006 and German Patent Application No. 10 2007 003 948.6, filed Jan. 26, 2007.

BACKGROUND OF THE INVENTION

1. Field of the Invention

The present invention relates to a lock unit comprising at least a catch, a first pawl having a pawl rotation axis, and a blocking lever, wherein in a locked state, the catch of the lock unit transfers a pivoting moment onto the first pawl and wherein the first pawl is fixed by means of a blocking lever. Lock units of this type are used in particular in motor vehicles for the purpose of locking doors, tailgates, or similar.

2. Brief Description of the Invention

In lock units described herein, the relative position between the catch and the pawl is not designed in such a way that the force exercised by the catch runs through the pawl rotation axis and consequently allows for an automatic fixation of the catch by means of the pawl. Instead, in order to provide a particularly quietly-operating lock unit, the pawl is in this case designed or arranged in such a way that the force exerted by the catch produces a turning moment for the pawl, facilitating the release of the catch. To this extent, the catch produces an opening moment for the first pawl so that said pawl can be easily moved into the opened position as a result of the spring-loading of the catch.

Equally, in order to guarantee a lasting locked state, provided is a blocking lever for fixing the first pawl in the locking position so that in particular, displacements of position in relation to the locking mechanism (for instance by compressing the door seals, the driving operation or similar) do not cause the lock unit to open or the contact between pawl and catch to be interrupted. In this way is the "self-opening" of the locking mechanism prevented.

Also in view of the increased number of parts used by such a locking system, a reliable operation of the complex sequence of movements in all operating conditions is desirable, whilst at the same time a compact design and a silently-operating locking system are of utmost importance.

It is one objective of the invention to at least partially solve the problems described with reference to the state of the art. In particular, the invention aims to provide a lock unit with a self-opening mechanism that still offers a compact and simple design.

These objectives are solved by a lock unit according to the characteristics of claim 1. Further advantageous embodiments of the lock unit and its preferred area of application are apparent from the dependent claims. It must be pointed out that the characteristics individually listed in the claims can be combined in any technologically sensible manner and illustrate further embodiments of the invention. Furthermore, the description, in particular with reference to the figures, explains further advantages and preferred embodiments of the invention.

The lock unit of the invention comprises at least a catch, a first pawl having a pawl rotation axis, and a blocking lever. In the locked state of the lock unit, the catch transfers a pivoting moment onto the first pawl and the first pawl is fixed by the blocking lever. Furthermore, a second pawl is provided, which is mounted on the pawl rotation axis and which can be engaged with the blocking lever and the catch.

The lock unit is in particular a lock for a motor vehicle door, although the lock unit can generally also be used in other doors, tailgates, etc. The function of the so-called locking mechanism—comprising a catch and a pawl—in motor vehicle locks is generally known, so that at this point it is only mentioned that a catch bolt is accommodated via the (spring-loaded) catch and fixed in a locked state. In order to stop the rotation of the catch, said catch bolt comprises a so-called intermediate-closed stop on its outer profile with which a respective elevation of the first pawl engages. For this purpose, the pawl carries out a rotary movement and then forms a contact area with the catch as the catch and pawl abut against each other.

In the locked state, the catch pushes onto a contact point (or small contact area) of the first pawl so that a moderate or ideal contact force vector is created. The contact force vector generally has a length (essentially corresponding to the amount of the force) and a direction into which the force (from the catch towards the first pawl) is exerted. In the "self-opening" mechanism this contact force vector does not point from the contact point towards the pawl rotation axis, but instead the contact force vector is arranged at an angle to said axis. This causes a pivoting moment in relation to the first pawl to be generated via the catch, the catch pushing the first pawl into the open position. In order to generate such an angled contact force vector, the contact surfaces between the first pawl and the catch around the area of the contact point and/or the position of both components may, in particular, be adapted in relation to each other. By using such an arrangement of the contact force vector, a particularly-smooth and thus also a silent operation of the pawl can be achieved during the opening of the locking mechanism.

In order to prevent the self-opening of the mechanism, a blocking lever is provided. Said lever is, in particular, positioned in such a way that it abuts against the first pawl and generates a blocking force counteracting the pivoting moment. In the locked state of the lock unit, the first pawl rests, for instance, against the fully-closed stop of the catch with the blocking lever being positioned on the side of the first pawl facing the catch. This blocking lever is, in particular, arranged pivotably and blocks the opening position of the first pawl in the locked state.

In order to achieve simple movement sequences and a compact design, in addition to the first pawl, a second pawl is provided, the second pawl being arranged on the same pawl rotation axis as the first pawl. The first and the second pawls can be moved independently from each other around the pawl rotation axis, at least within a (limited) area of rotation (e.g., from 10° to 60°). The second pawl can then on the one hand engage the blocking lever and on the other hand engage the catch. Thus, the second pawl carries out a double function (offset in time or delimited from each other), that is to say, acting on the one hand as a "normal" pawl in relation to the catch and, in addition, as a triggering lever for the blocking lever so that in the locked state of the catch, the first pawl and the blocking lever are disconnected from one another by the second pawl, which can be brought into contact with the blocking lever.

Particularly advantageous is an embodiment in which the catch comprises a fully-closed stop and an intermediate-closed stop, and in which the first pawl can engage with the fully-closed stop and the second pawl can engage with the intermediate-closed stop. In other words, this means, in particular, that the second pawl (with the first pawl engaged in the fully-closed stop of the catch) acts as a triggering mechanism for the blocking lever. Furthermore, the second pawl can also operate as a pawl in another state (offset in time) of the lock unit or of the locking mechanism by said pawl arresting (on its own) the catch in or at the intermediate-closed stop. This allows the option of designing the catch with a less complex form because due to the relative movement of the two pawls, different target points for a contact with the pawl or the catch can be provided.

According to a further embodiment of the lock unit, it is suggested that the second pawl comprises a release arm with a release journal which at times can be made to abut against a link of the blocking lever. This illustrates that the pawl does not only form a lever extending along an axis but also a release arm particularly extending at an angle from said lever. The release arm comprises at least a release journal extending, in particular, vertically to the pawl plane to cooperate, for instance, with a blocking lever arranged below or parallel to said plane. The blocking lever and the second pawl are now actually arranged in such a way that the release journal can at times cooperate with the connecting link of the blocking lever during pivoting of the second pawl, and in particular in a predefined pivoting area. It is preferred that the release journal is in contact with the link at the exact point in time when the first pawl is to be released. For this purpose a pivoting of the blocking lever against its frictional force towards the first pawl and a spring tensioning force is produced by means of the second pawl.

According to a further embodiment of the lock unit, the second pawl contains a blocking arm with a seat that can at times abut against the catch. This blocking arm serves in particular to interact with the catch in the area of the so-called intermediate-closed stop. Where the catch features a bolt extending from the plane of the catch, the face of the blocking arm forms a respective recess. Preferably a contact force acts in this case between the catch and the second pawl extending through the pawl rotation axis. Consequently, this suggests a non-self-opening mechanism.

The second pawl can also contain an operating arm connected to an operating lever. The operating lever thus serves, in particular, as a target point for the operating lever extending out of a housing of the lock unit and cooperating directly or indirectly with the actuation devices on the door or tailgate (e.g., a so-called internal operating lever and/or external operating lever). Such an operating lever can be designed as a rod assembly and/or a Bowden cable. Preferably, the operating arm of the second pawl is positioned on a side opposite to the release arm or blocking arm in relation to the pawl rotation axis.

In a particularly preferred embodiment, the second pawl contains a separate release arm, a separate blocking arm, and a separate operating arm. Such a second pawl is, in particular, designed as a flat molded part and is made, in particular, of metal and/or plastic.

It is also advantageous that means for limiting the relative pivoting movement is provided between the first and second pawl. Such means for limiting the relative pivoting movement has primarily the task of ensuring reliable unlocking even in a circumstance when the self-opening mechanism for ejecting the first pawl does not function. For this purpose it is particularly preferred that the first pawl and the second pawl are pivoted in the same direction around the pawl rotation axis during the opening operation so that the second pawl pivots the blocking lever during a first displacement phase and later (preferably offset in time) the second pawl pivots the first pawl (in particular where necessary, when the catch does not change the position of the first pawl).

Finally, also a motor vehicle is suggested comprising at least one described lock unit according to the invention. Such a lock unit is intended in particular for locking doors and/or tailgates of such motor vehicles.

BRIEF DESCRIPTION OF THE DRAWINGS

The invention and the technical field are now explained in more detail with reference to the figures. It must be pointed out that the figures show particularly preferred embodiments of the invention but the invention is not limited to these. The following are shown in diagrammatic form.

DETAILED DESCRIPTION OF THE INVENTION

Figure 1:
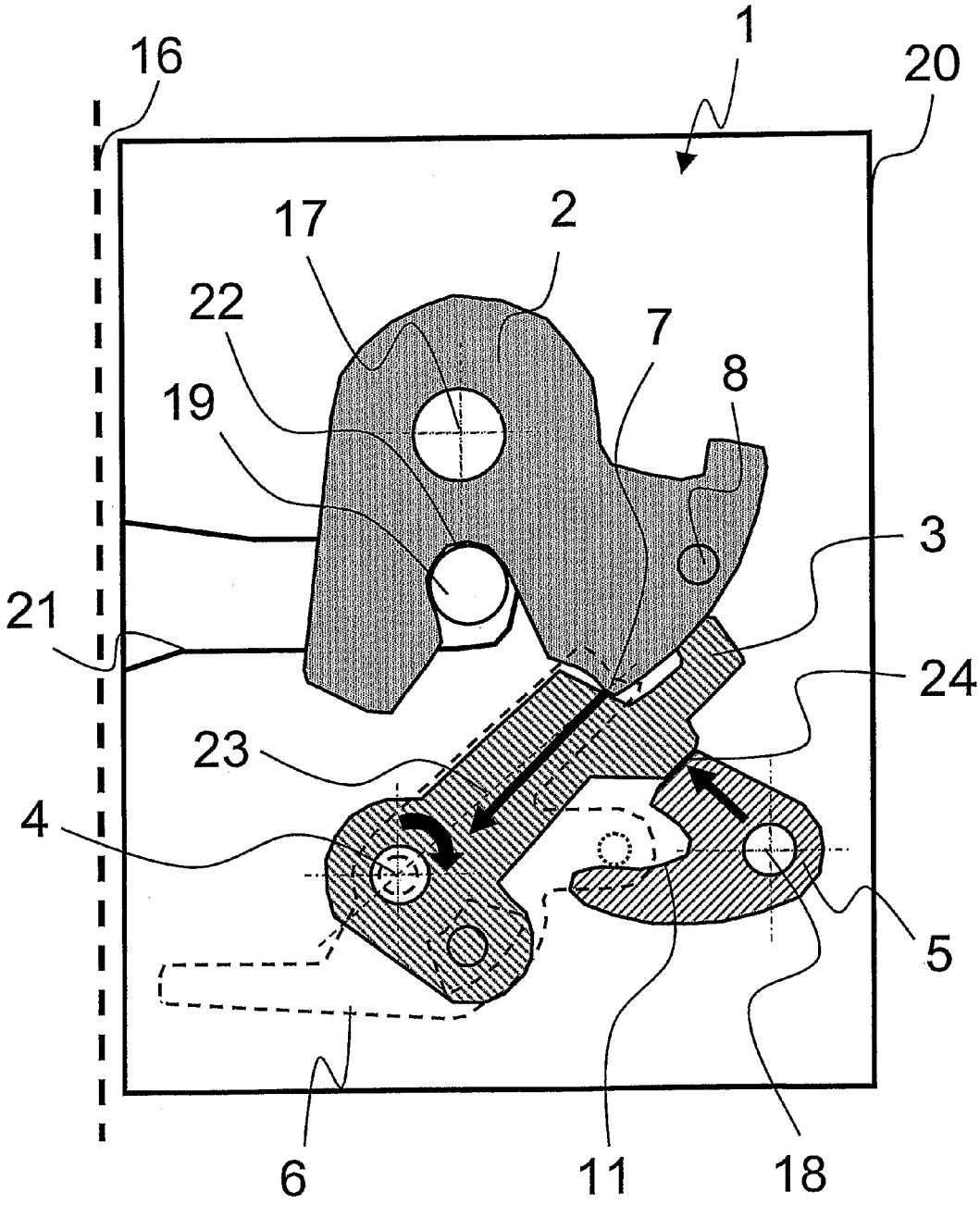
FIG. 1: a first embodiment of a lock unit according to the invention in a closed state.

FIG. 1 shows a schematic view of a lock unit 1 of a motor vehicle 16 only indicated in the drawing. The locking mechanism, comprising catch 2 and the first pawl 3, is arranged in a housing 20 positioned for instance in or on a motor vehicle door. The lock unit 1 serves to fix a catch bolt 19 (also called striker) attached to the motor vehicle body which is inserted into the inlet 21 during the closing operation of the motor vehicle door.

FIG. 1 illustrates the self-opening mechanism of the locking mechanism with the catch 2, the first pawl 3, and the blocking lever 5 being arranged on one plane of the lock unit 1. In the locked state shown, the catch bolt 19 is securely accommodated in the recess 22 of the spring-loaded catch 2 pivotable in the usual manner around the catch rotation axis 17. The rotation (here clockwise) of the catch 2 caused by the spring-loading is impeded by the first pawl 3 abutting against the fully-closed stop 7 of the catch 2. The catch 2 now forms a contact force vector in the contact area—shown here as a black arrow—not pointing towards the pawl rotation axis 4. Instead an angle between the contact force vector and the connection 23 is provided between the fully-closed stop 7 and the pawl rotation axis 4 so that this contact force generates a pivoting moment relative to the first pawl 3. In order to prevent opening, a blocking lever 5, pivotable around the blocking lever rotation axis 18, is provided on the side of the pawl 3 facing the catch 2. In this position said lever forms a stop 24 for the first pawl 3 with the applied contact force running through the blocking lever rotation axis 18. In this way the first pawl 3 is securely fixed to the fully-closed stop 7 of the catch 2. Consequently, a reliable positioning of the first pawl 3 can also be guaranteed in the event of a further counter-clockwise rotation of the catch 2 (for instance during compression of door seals).

The second pawl 6—only indicated in the drawing—is positioned on a plane above the plane of observation, said second pawl 6 being mounted on the same pawl rotation axis 4 as the first pawl 3. This is illustrated below in FIG. 2.

Figure 2:
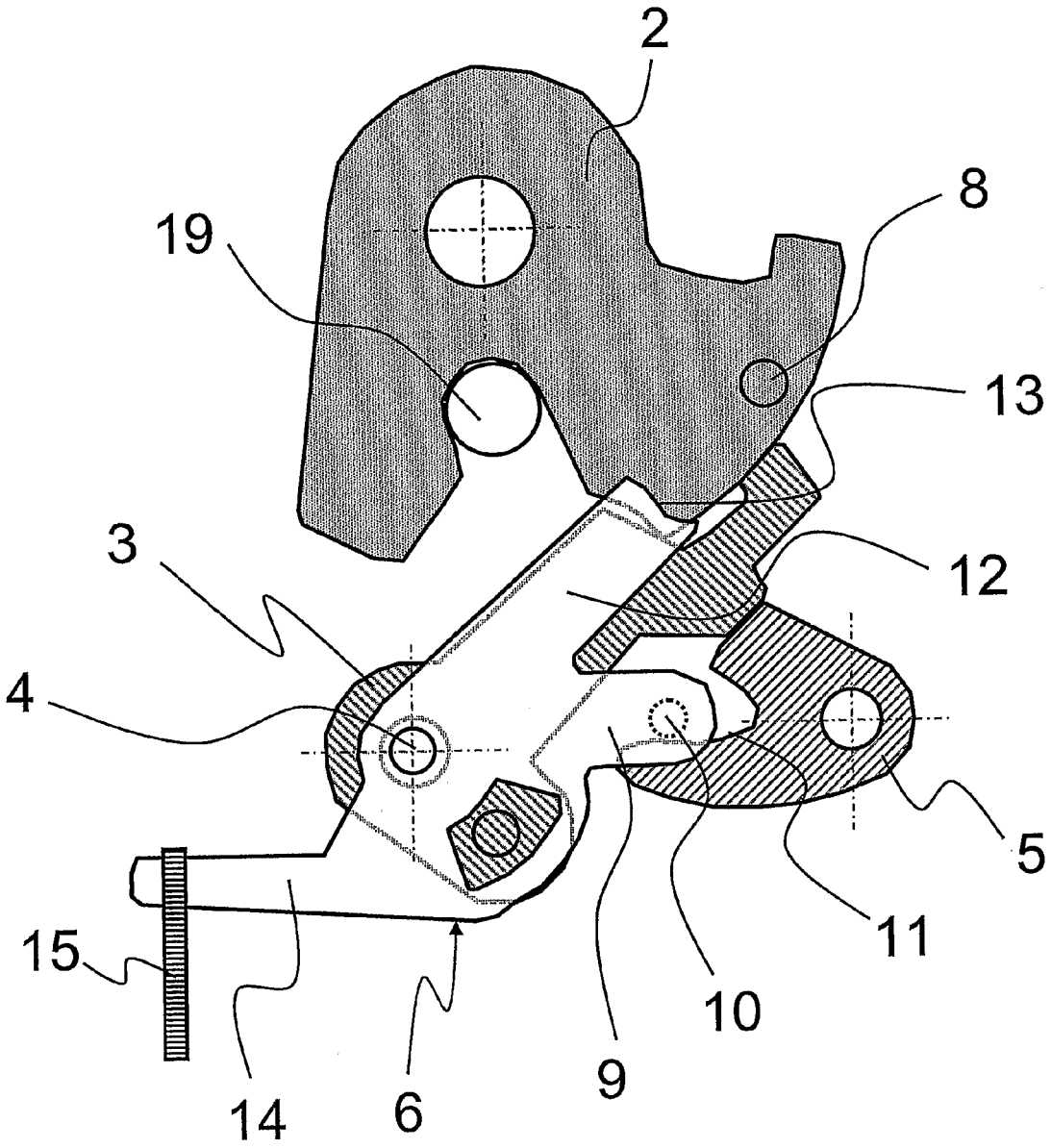
FIG. 2: the lock unit of FIG. 1 in another plane.

FIG. 2 shows the explained locking mechanism and the second pawl 6 arranged in parallel (above it). The second pawl 6 essentially contains three arms, namely a blocking arm 12, a release arm 9, and an operating arm 14. With respect to the position of the individual arms of the second pawl 6, it is assumed that the operating arm 14 is arranged on another side in relation to the pawl rotation axis 4 than the release journal 9 and the blocking arm 12. To release the locked state of the locking mechanism, the second pawl 6 can be pivoted around the pawl rotation axis 4 by means of an operating lever 15 linked to operating arm 14. In order to prevent any noise and to ensure a direct opening operation, a release journal 10 of the second pawl 6 extending into the plane of the blocking lever 5, abuts against a connecting link 11 of the blocking lever 5 at that point in time. This ensures that the blocking lever 5 is already moved by a short travel of the operating lever 15 or by a slight pivoting movement of the second pawl 6. It is furthermore preferred that there is no further interaction between the second pawl 6, for instance with the catch 2 or the first pawl 3 in the locked state.

Figure 3:
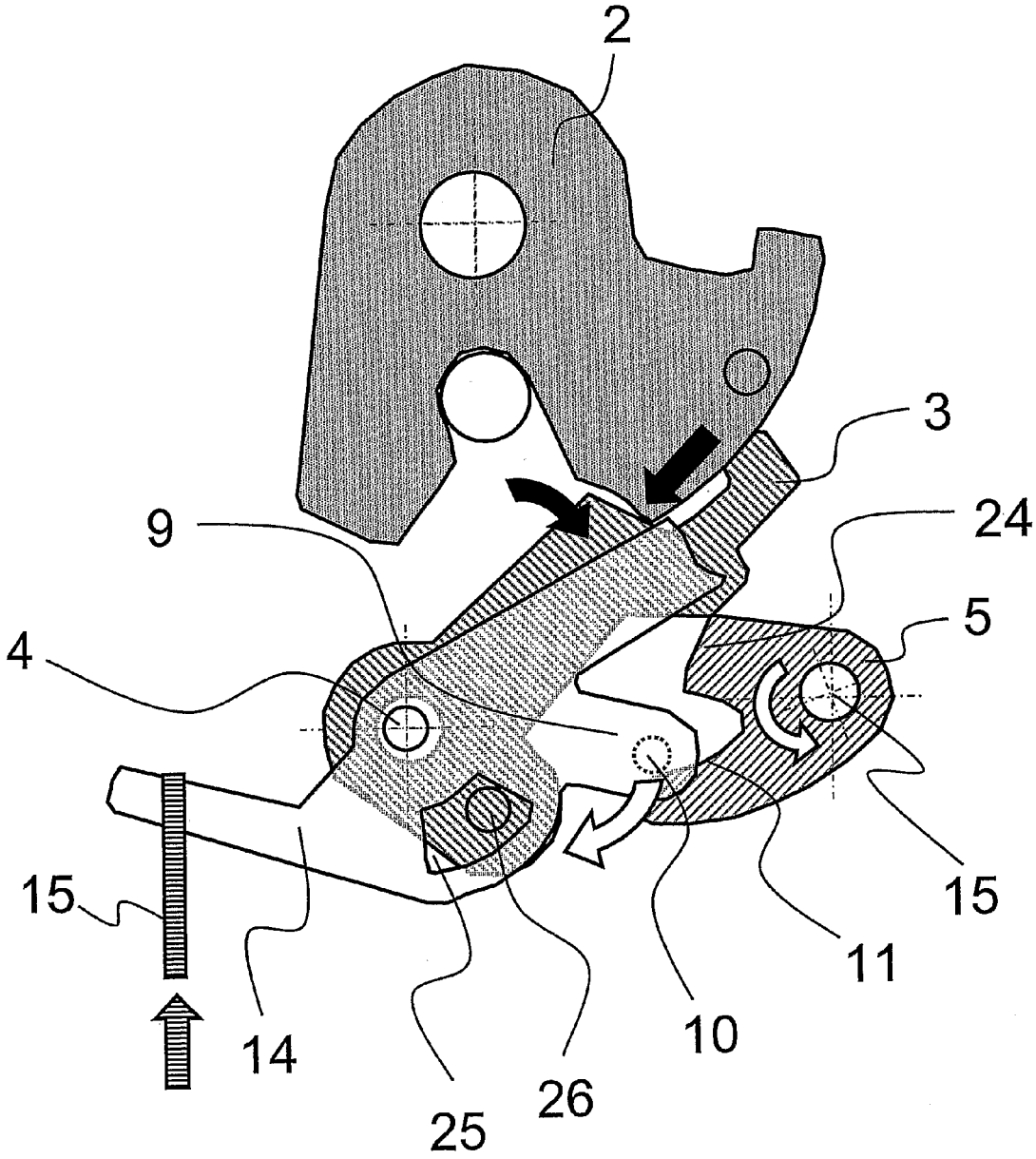
FIG. 3: the lock unit of FIG. 2 during the opening operation.

The individual sequences of movement during opening of the lock unit are illustrated in FIG. 3. This figure shows, in particular, the position of the individual components at the point in time when the blocking lever 5 releases the first pawl 3. The individual sequences of movement are indicated by different arrows.

First of all, the release journal 10 of the release arm 9 of the second pawl 6 is brought into contact with the operating lever 5 by changing the position of the operating lever 15 (here upwards along an axis). The circular movement of the release journal 10 (indicated by a white arrow) and its contact with connecting link 11 now causes the blocking lever 5 (also indicated by a white arrow) to pivot. Stop 24 consequently moves away from the first pawl 3 and is released.

During this process the spring-loaded catch 2 pushes against the first pawl 3 (black arrow), effecting an opening or pivoting moment (indicated by a black arrow) around the pawl rotation axis 4 of the first pawl. Where the stop 24 of the blocking lever 5 now releases the first pawl 3, the catch 2 pivots the first pawl 3 in direction of the opening position. The force required for this is normally guaranteed by the spring-loaded catch 2 and the door sealing forces acting on the catch 2 via the catch bolt.

In a few exceptional situations it can, however, happen that these forces are not or are not sufficiently applied. As a reliable opening of the locking mechanism must still be guaranteed in these situations, the first pawl 3 comprises a catch 26 which, in the event that the first pawl 3 is not "automatically" pivoted, is moved along by the recess 25 of the second pawl 6. The recess 25 or the catch 26 is designed in such a way that at the point of release of stop 24 of the blocking lever 5 from the first pawl 3, some play (i.e., no contact) remains between the catch 26 and the recess 25. This play is generally such that slight pivoting relatively between the pawls is possible, during which time catch 2 normally activates the pivoting movement of the first pawl 3 so that normally there is no contact between recess 25 and carrier 26, in order to prevent the generation of noise.

Figure 4:
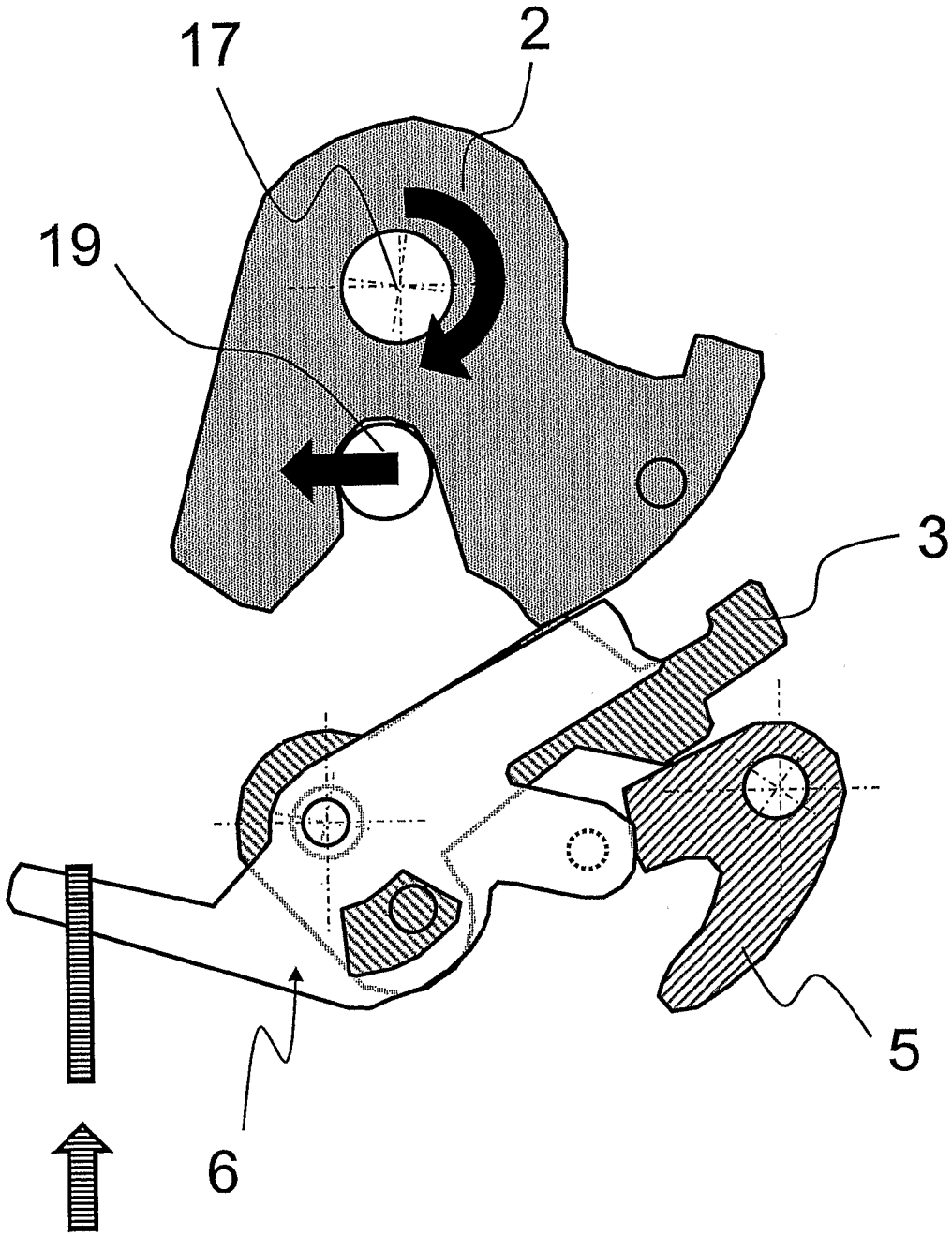
FIG. 4: the pivoting of the catch into the open position.
Figure 5:
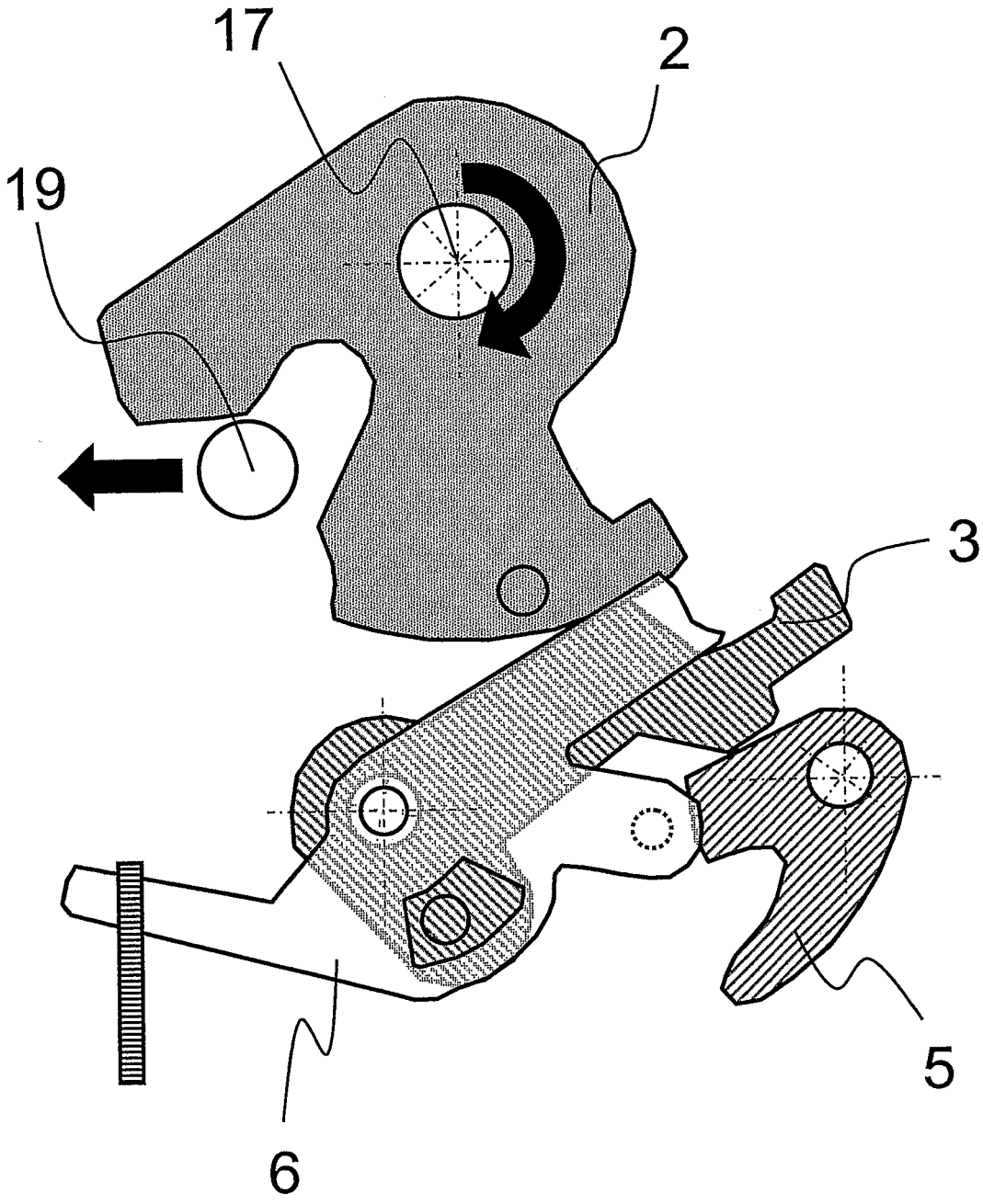
FIG. 5: the lock unit of the previous figures in an open state.

FIG. 4 shows how a free pivotal movement of catch 2 around the catch rotation axis 17 is made possible. At the same time, the rotation of the catch 2 (indicated by a black arrow) causes a displacement of the relative position towards the catch bolt 19. The pivoting movement of the catch 2 or the translatory movement of the catch bolt 19 continues until the catch 2 fully releases the catch bolt 19, as shown in FIG. 5.

Figure 6:
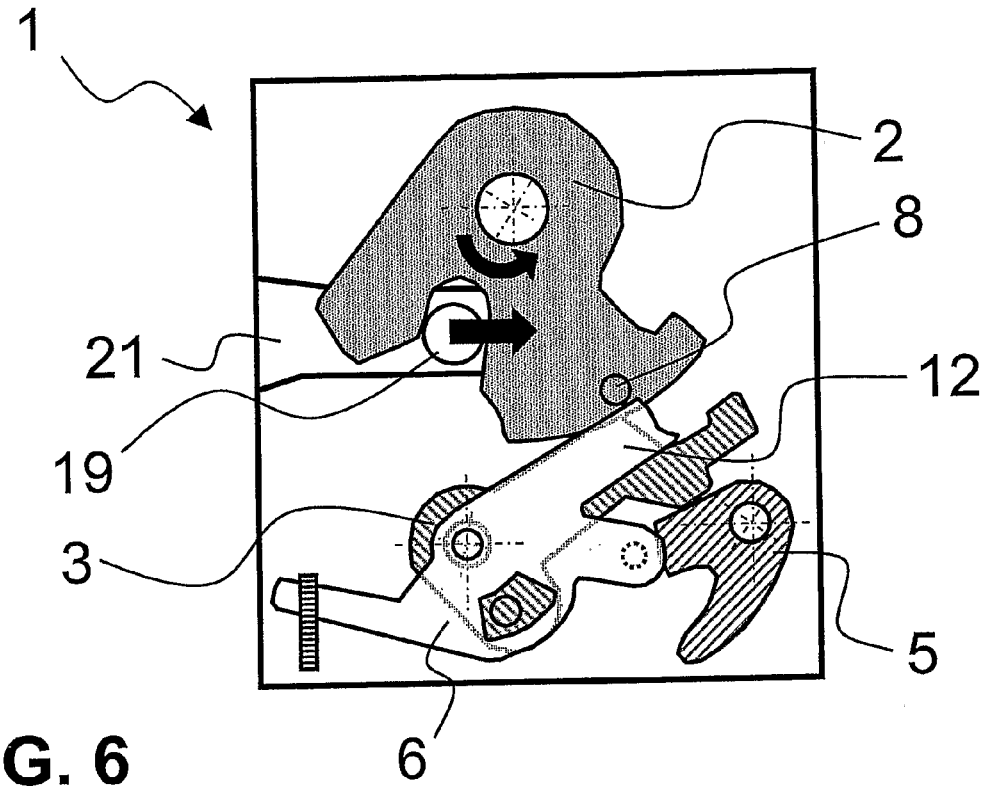
FIG. 6: a further embodiment of a lock unit during the closing operation.
Figure 7:
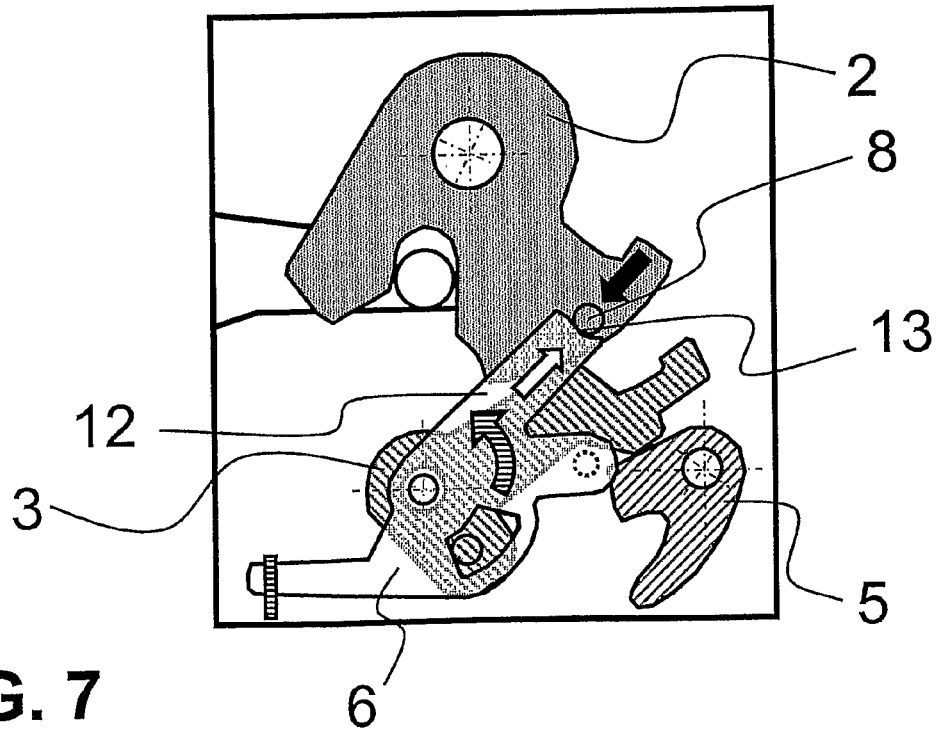
FIG. 7: the lock unit of FIG. 6 in the so-called intermediate-closed position.

While the above figures illustrate the opening process, FIGS. 6 to 9 demonstrate a possible closing process. FIG. 6 illustrates how the catch bolt 19 introduced in the inlet 21 effects the rotation of the catch 2 against the spring force (indicated by black arrows). During this phase of the closing process, the pawls 3 and 6 can, for instance, abut against an outer profile of the catch 2 with their pivoting movements not being significantly impeded and noise being avoided. In the embodiment shown in this figure, the blocking arm 12 of the second pawl 6 lies directly against the bolt-like intermediate-closed stop 8 of the catch 2. At the same time the second pawl 6 is spring-loaded and attempts to move around the pawl rotation axis in a counter-clockwise direction.

Once the intermediate-closed stop 8 has passed over the blocking arm 12, the second pawl 6 pivots so that the blocking arm 12 forms a support point for the intermediate-closed stop 8 with its seat 13. In this position re-opening of the catch 2 without reactivation of the lock unit is prevented. When the lock is in this position, electromotive devices can, where required, intervene and effect a further rotation of the catch 2. A rotation of the catch 2 can, for instance, be carried out up to a so-called overtravel position, describing a position of the catch 2 exceeding the locked state. This ensures that the pawl, which can be brought to abut against a fully-closed stop 7, engages securely.

Figure 8:
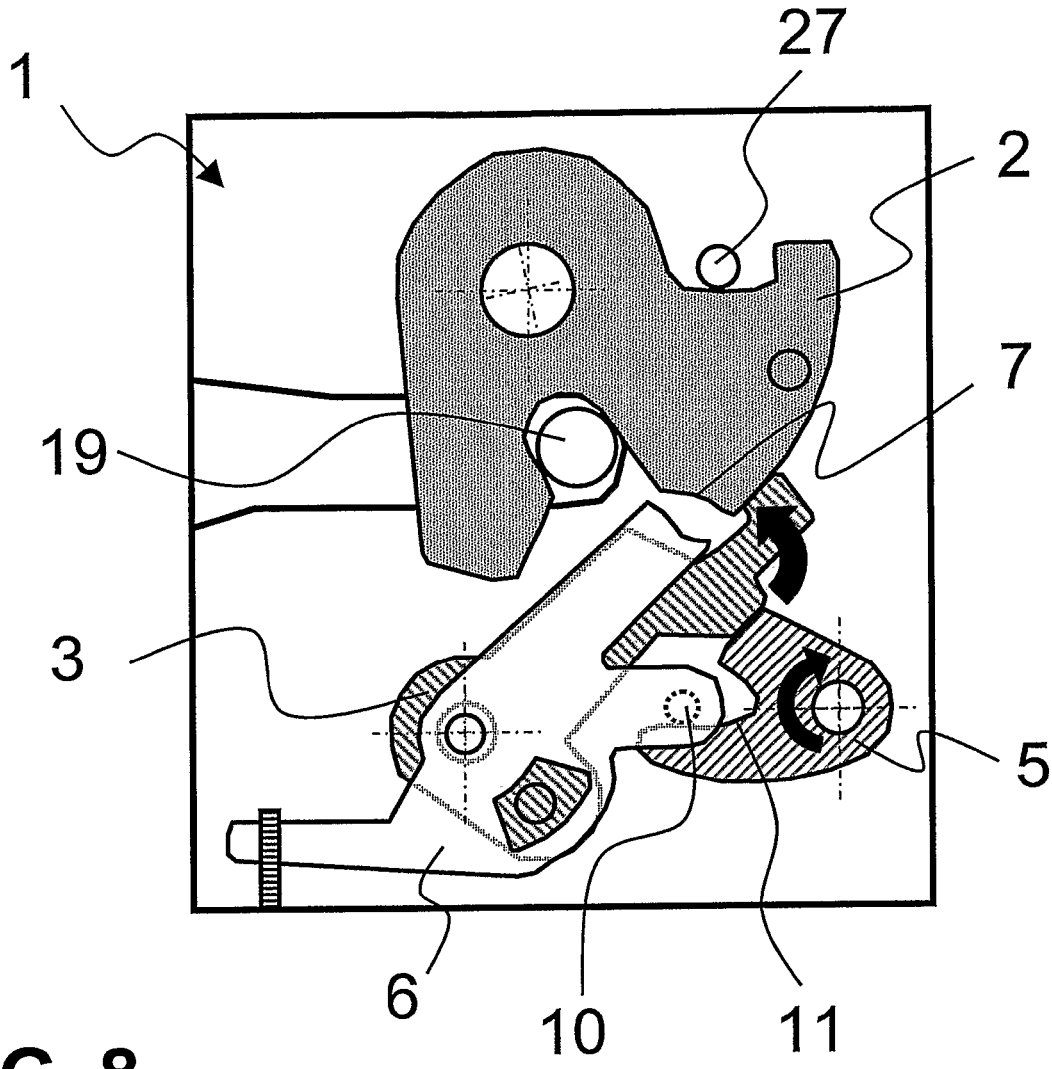
FIG. 8: the lock unit of FIGS. 6 and 7 in the so-called overtravel position.

This overtravel state is shown in FIG. 8. In this state, the catch 2 is "turned excessively" and is, for instance, brought into contact with a stopper 27. The spring-loaded blocking lever 5 now rotates in the clockwise direction around the blocking lever rotation axis whilst pushing the first pawl 3 towards the catch 2 so that it engages securely in the fully-closed stop 7 during the back movement of the catch 2.

The described lock unit of the invention provides a reliable and quiet operation while requiring only low operating forces and little operating space.

INDEX OF REFERENCE NUMBERS

1 Lock unit
2 Catch
3 First pawl
4 Pawl rotation axis
5 Blocking lever
6 Second pawl
7 Fully-closed stop
8 Intermediate-closed stop
9 Release arm
10 Release journal
11 Connecting link
12 Blocking arm
13 Seat
14 Operating arm
15 Operating lever
16 Motor vehicle
17 Catch rotation axis
18 Blocking lever rotation axis
19 Catch bolt
20 Housing
21 Inlet
22 Recess
23 Connection
24 Stop
25 Recess
26 Catch
27 Stopper

The invention claimed is:

1. A lock unit comprising
a catch, a first pawl having a pawl rotation axis about which the first pawl pivots between a locking position blocking movement of the catch in an opening direction and a releasing position allowing movement of the catch in the opening direction, a blocking lever, and a second pawl mounted on the pawl rotation axis and engageable with the blocking lever and the catch, wherein the catch in a locked state of the lock unit and when biased toward the first pawl, engages the first pawl at a contact area between the catch and the first pawl and applies to the first pawl a force acting in the direction of a contact force vector, the contact force vector in the locked state of the lock unit not pointing towards the pawl rotation axis but instead to a side of the pawl rotation axis such that the catch applies a pivoting moment to the first pawl in a direction going from the locking position to the releasing position of the first pawl, and wherein in a locked state of the lock unit movement of the first pawl from the locking position to the releasing position is blocked by a blocking lever.

2. The lock unit of claim 1, wherein the catch comprises a fully-closed stop and an intermediate-closed stop, wherein the first pawl is engageable with the fully-closed stop and the second pawl is engageable with intermediate-closed stop.

3. The lock unit of claim 1, wherein the second pawl comprises a release arm with a release journal, and said release journal can be moved into contact with the connecting link of the blocking lever.

4. The lock unit of claim 1, wherein the second pawl comprises a blocking arm with a seat, and said seat can be moved at times into contact with the catch.

5. The lock unit of claim 1, wherein the second pawl comprises an operating arm connected to an operating lever.

6. The lock unit of claim 1, wherein means for limiting the relative pivoting is provided between the first pawl and the second pawl.

7. A motor vehicle comprising at least one lock unit according to claim 1.

8. The lock unit of claim 2, wherein the second pawl comprises a release arm with a release journal, and said release journal is engageable with the connecting link of the blocking lever.

9. The lock unit of claim 2, wherein the second pawl comprises a blocking arm with a seat, and said seat is engageable with the catch.

10. The lock unit of claim 3, wherein the second pawl comprises a blocking arm with a seat, and said seat is engageable with the catch.

11. The lock unit of claim 2, wherein the second pawl comprises an operating arm connected to an operating lever.

12. The lock unit of claim 3, wherein the second pawl comprises an operating arm connected to an operating lever.

13. The lock unit of claim 4, wherein the second pawl comprises an operating arm connected to an operating lever.

14. The lock unit of claim 2, wherein means for limiting the relative pivoting is provided between the first pawl and the second pawl.

15. The lock unit of claim 3, wherein means for limiting the relative pivoting is provided between the first pawl and the second pawl.

16. The lock unit of claim 4, wherein means for limiting the relative pivoting is provided between the first pawl and the second pawl.

17. The lock unit of claim 5, wherein means for limiting the relative pivoting is provided between the first pawl and the second pawl.

18. A lock unit, comprising:

a spring-loaded catch rotatable about a catch rotation axis;

a first pawl rotatable about a pawl rotation axis between a locking position blocking movement of the catch in an opening direction and a releasing position allowing movement of the catch in the opening direction;

a second pawl rotatable about the same pawl rotation axis; and a blocking lever rotatable about a blocking lever rotation axis;

wherein in a locked state of the lock unit, the catch is biased into contact with the first pawl at a contact area between the catch and the first pawl and applies to the first pawl a force acting in the direction of a contact force vector, the contact force vector in the locked state of the lock unit not pointing towards the pawl rotation axis but instead to a side of the pawl rotation axis such that, the catch applies a pivoting moment to the first pawl in a direction going from the locking position to the releasing position of the first pawl; and during an opening movement, the second pawl actuates the blocking lever causing the blocking lever to pivot and move away from the first pawl, thereby setting free the first pawl and allowing rotation of the first pawl by the catch.

19. The lock unit of claim 18, wherein in the locked state of the lock unit, the blocking lever applies to the first pawl in an area of a stop for the first pawl a force acting in the direction of a second contact force vector, the second contact force vector passing through the blocking lever rotation axis.

20. A lock unit comprising a catch, a first pawl having a pawl rotation axis about which the first pawl rotates between a locking position blocking movement of the catch in an opening direction and a releasing position allowing movement of the catch in the opening direction, a blocking lever, and a second pawl mounted on the pawl rotation axis and engageable with the blocking lever and the catch, wherein the catch in a locked state of the lock unit and when biased toward the first pawl, engages the first pawl at a contact area between the catch and the first pawl and applies to the first pawl a force acting in the direction of a contact force vector, the contact force vector in the locked state of the lock unit not pointing towards the pawl rotation axis, but rather forming an angle with a line connecting the pawl rotation axis and the contact area between the catch and the first pawl such that the catch applies a pivoting moment to the first pawl in a direction going from the locking position to the releasing position of the first pawl for facilitating a release of the catch, and wherein in a locked state of the lock unit movement of the first pawl is blocked by a blocking lever.

* * * * *

UNITED STATES PATENT AND TRADEMARK OFFICE

CERTIFICATE OF CORRECTION

PATENT NO. : 8,480,138 B2
APPLICATION NO. : 12/515951
DATED : July 9, 2013
INVENTOR(S) : Bendel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 481 days.

Signed and Sealed this
Eighth Day of September, 2015

Michelle K. Lee

Michelle K. Lee
*Director of the United States Patent and Trademark Office*